US011505840B2

(12) United States Patent
Maggioli

(10) Patent No.: US 11,505,840 B2
(45) Date of Patent: Nov. 22, 2022

(54) COOLING PLATE FOR METALLURGICAL FURNACE

(71) Applicant: PAUL WURTH S.A., Luxembourg (LU)

(72) Inventor: Nicolas Maggioli, Thionville (FR)

(73) Assignee: PAUL WURTH S.A., Luxembourg (LU)

( * ) Notice: Subject to any disclaimer, the term of this patent is extended or adjusted under 35 U.S.C. 154(b) by 571 days.

(21) Appl. No.: 16/483,731

(22) PCT Filed: Feb. 2, 2018

(86) PCT No.: PCT/EP2018/052678

§ 371 (c)(1),
(2) Date: Aug. 5, 2019

(87) PCT Pub. No.: WO2018/146021

PCT Pub. Date: Aug. 16, 2018

(65) Prior Publication Data

US 2020/0024676 A1 Jan. 23, 2020

(30) Foreign Application Priority Data

Feb. 9, 2017 (LU) ..... 100073

(51) Int. Cl.
*C21B 7/10* (2006.01)
*F27B 3/24* (2006.01)
(Continued)

(52) U.S. Cl.
CPC ..... *C21B 7/103* (2013.01); *F27B 3/24* (2013.01); *F27B 3/28* (2013.01); *F27D 9/00* (2013.01);
(Continued)

(58) Field of Classification Search
CPC ... C21B 7/103; F27B 3/24; F27B 3/28; F27D 2009/0018; F27D 2009/0048; F27D 2009/0067; F27D 9/00
(Continued)

(56) References Cited

U.S. PATENT DOCUMENTS 4,217,954 A * 8/1980 Vincent ..... F27D 1/12 165/905
4,250,840 A * 2/1981 Kudinov ..... C21B 7/10 122/406.1
(Continued)

FOREIGN PATENT DOCUMENTS

DE 3313998 A1 12/1983
JP S58123805 * 7/1983 ..... C21B 7/103
(Continued)

OTHER PUBLICATIONS

International Preliminary Report on Patentability dated Jan. 30, 2019 re: Application No. PCT/EP2018/052678, pp. 1-13.
(Continued)

*Primary Examiner* — Scott R Kastler
*Assistant Examiner* — Michael Aboagye
(74) *Attorney, Agent, or Firm* — Cantor Colburn LLP

(57) ABSTRACT

A cooling plate for a metallurgical furnace including a body with a front face and an opposite rear face, the body having at least one cooling channel therein having an opening in the rear face and a coolant feed pipe is connected to the rear face of the cooling panel and is in fluid communication with the cooling channel, where in use, the front face is turned towards a furnace interior, and at least one emergency cooling tube is arranged within the cooling channel, the emergency cooling tube having a cross-section smaller than a cross-section of the cooling channel, the emergency cooling tube has an end section with connection means for
(Continued)

connecting an emergency feed pipe thereto, and in an emergency operation, the emergency cooling tube is physically connected to an emergency feed pipe via the connection means; while, in a normal operation, the connection means of the emergency cooling tube is physically disconnected from the emergency feed pipe. The invention also concerns the use of such a cooling plate.

18 Claims, 5 Drawing Sheets

(51) Int. Cl.
*F27B 3/28* (2006.01)
*F27D 9/00* (2006.01)

(52) U.S. Cl.
CPC ..... *F27D 2009/0018* (2013.01); *F27D 2009/0048* (2013.01); *F27D 2009/0067* (2013.01)

(58) Field of Classification Search
USPC ..... 373/71, 76; 266/193, 194, 241
See application file for complete search history.

(56) References Cited

U.S. PATENT DOCUMENTS

| | | | | |
|---|---|---|---|---|
| 4,572,269 A * | 2/1986 | Ioshpa | ..... | F28F 1/00 164/94 |
| 7,217,123 B2 * | 5/2007 | Schmeler | ..... | C21B 7/10 432/83 |
| 10,082,336 B2 * | 9/2018 | Dratner | ..... | C21B 7/10 |

FOREIGN PATENT DOCUMENTS

| | | | | |
|---|---|---|---|---|
| JP | S58123805 A | 7/1983 | | |
| JP | 405306405 * | 9/1993 | ..... | F27B 3/24 |
| JP | H06158129 A | 6/1994 | | |
| JP | 2015187288 A | 10/2015 | | |

OTHER PUBLICATIONS

International Search Report dated Feb. 26, 2018 re: Application No. PCT/EP2018/052678, pp. 1-3.
Written Opinion dated Feb. 26, 2018 re: Application No. PCT/EP2018/052678, pp. 1-5.

* cited by examiner

COOLING PLATE FOR METALLURGICAL FURNACE

TECHNICAL FIELD

The present disclosure generally relates to cooling plates for metallurgical furnaces such as e.g. blast furnaces, and in particular to cooling plates with means for operating damaged cooling plates.

BACKGROUND

Cooling plates for metallurgical furnaces, also called "staves", are well known in the art. They are used to cover the inner wall of the outer shell of the metallurgical furnace, as e.g. a blast furnace or electric arc furnace, to provide a heat evacuating protection screen between the interior of the furnace and the outer furnace shell. They generally further provide an anchoring means for a refractory brick lining, a refractory guniting or a process generated accretion layer inside the furnace.

Originally, the cooling plates have been cast iron plates with cooling channels cast therein. As an alternative to cast iron staves, copper staves have been developed. Nowadays, most cooling plates for a metallurgical furnace are made of copper, a copper alloy or, more recently, of steel.

The refractory brick lining, the refractory guniting material or the process generated accretion layer forms a protective layer arranged in front of the hot face of the panel-like body. This protecting layer is useful in protecting the cooling plate from deterioration caused by the harsh environment reigning inside the furnace. In practice, the furnace is however also occasionally operated without this protective layer, resulting in erosion of the lamellar ribs of the hot face.

As it is known in the art, while the blast furnace is initially provided with a refractory brick lining on the front side of the staves or steel blades inserted in the grooves of the staves, this lining wears out during the campaign. In particular, it has been observed that, in the bosh section, the refractory lining may disappear relatively rapidly.

As the cooling plates are worn, mainly by abrasion, the coolant circulating through the cooling channel may leak into the furnace. Such leaks are of course to be avoided.

When such a leak is detected, the first reaction will generally be to stop feeding coolant to the leaking cooling channel until the next programmed stoppage, during which a flexible hose can be fed through the cooling channel, such as e.g. described in JP2015187288A. Subsequently, the flexible hose is connected to coolant feed and coolant may be fed through the flexible hose within the cooling plate. Thus, the metallurgical furnace can be operated further without having to replace the damaged cooling plate.

However, once the coolant feed through the leaking cooling channel is interrupted, material from the furnace may enter the cooling channel thereby hindering a subsequent installation of the flexible hose.

A severely worn cooling plate leads to a temperature increase of the copper surrounding the channel, which leads to a loss of copper mechanical properties. In some cases, this may lead to a complete destruction of the cooling late, which leaves the furnace shell directly exposed to high heat loads and to abrasion.

Also, the installation of the flexible hose into the cooling channel is rather complicated. The flexible hose needs to have smaller diameter than the cooling channel and have a rather thin wall thickness to be manipulated in the angles/corners of the cooling channel. Such a thin wall thickness of the flexible hose does not survive for a long time against abrasion. Thus, the flexible hose only allows prolonging the lifetime of the cooling plate for a short period of time.

BRIEF SUMMARY

The aim of the present disclosure is to provide an improved cooling plate, which provides quick and effective cooling in case of a compromised cooling channel.

The present disclosure concerns a cooling plate for a metallurgical furnace comprising a body with a front face and an opposite rear face, the body having at least one cooling channel therein. The cooling channel has an opening in the rear face and a coolant feed pipe is connected to the rear face of the cooling panel and is in fluid communication with the cooling channel. In use, the front face is turned towards a furnace interior. According to the present disclosure, at least one emergency cooling tube is arranged within the cooling channel, the emergency cooling tube having a cross-section smaller than a cross-section of the cooling channel. The emergency cooling tube has an end section with connection means for connecting an emergency feed pipe thereto. In an emergency operation, the emergency cooling tube is physically connected to an emergency feed pipe via the connection means. In a normal operation, the connection means of the emergency cooling tube is physically disconnected from the emergency feed pipe.

Such a cooling panel with preinstalled emergency cooling tube allows for a quick switching from a normal operating mode to an emergency operating mode when the cooling panel becomes damaged.

If a leak is detected, i.e. if the body of the cooling plate is damaged in such a way that coolant leaks towards the front face of the cooling panel and thus into the furnace, the feeding of coolant through the coolant feed pipe is interrupted. An emergency feed pipe is then fed through the coolant feed pipe and connected to the emergency cooling tube already present in the cooling channel. Coolant is then fed via the emergency feed pipe to the emergency cooling tube and through the cooling panel. There is no need to first feed a flexible hose through the damaged, possibly blocked, cooling channel. The time between switching of the coolant feed through the cooling channel and the switching on of the coolant feed through the emergency cooling tube is greatly reduced. Also, the design of the emergency cooling tube, with respect to the flexible hose, is improved and more robust.

The emergency cooling tube is designed to withstand the harsh conditions reigning inside the furnace. To this effect, the emergency cooling tube may be made of steel or alloys. Preferably, the emergency cooling tube may be further provided with a coating of resistant material, such as e.g. tungsten.

As the emergency cooling tube is smaller in cross-section than the cooling channel, the emergency cooling tube does, during normal operation, not remove the direct connection between the coolant and the body of the cooling panel. Thus, the presence of the emergency cooling tube does not reduce the cooling efficiency of the cooling plate.

The cooling channel may be drilled, forged or cast in the body of the cooling panel.

The emergency cooling tube may generally be of circular cross-section. It should be noted, however, that any other shape that may be obtained by pipe extrusion methods, machining, casting or 3D-printing. The cooling channel may be of any shape that can be produced by machining or casting. It may e.g. be circular, oblong or a more complex shape achieved by overlapping different shapes.

The cross-section of the emergency cooling tube may have a cross-section at most three quarters (¾), preferably at most half (½), of the cross-section of the cooling channel. Such an emergency cooling tube would be sufficient to warrant adequate cooling during emergency operation, without however hindering the direct heat transfer between the coolant and the body of the cooling panel during normal operation.

According to one embodiment of the present disclosure, the end section of the emergency cooling tube comprises a bent portion. Such a bent portion ensures that the tube opening of the emergency cooling tube is in alignment with the coolant feed pipe, providing easy access for connecting the emergency feed pipe when needed.

Preferably, the cooling channel is formed by a first bore hole and a second bore hole, wherein the first and second bore holes overlap. The second bore hole may have a smaller diameter than the first bore hole and may be arranged in a direction facing the rear face of the cooling plate, wherein the second bore hole is arranged and dimensioned so as to accommodate the emergency cooling tube.

According to another embodiment of the present disclosure, the end section is straight and comprises the connection means in a lateral portion of the end section. An emergency cooling tube with such a straight end section may be easily installed in a cooling channel. The end of the end section is preferably capped.

The cooling channel may be formed by a number of overlapping bore holes. Preferably, the cooling channel is formed by a central bore hole and two auxiliary bore holes arranged either side of the central bore hole. Both the auxiliary bore holes overlapping the central bore hole. The central bore hole is arranged and dimensioned so as to accommodate the emergency cooling tube.

The diameter of the central bore hole may essentially correspond to the outer diameter of the emergency cooling tube, whereby the emergency cooling tube may snuggly sit in the central core hole by press-fit. Direct contact of the coolant with the body of the cooling plate may be achieved by the coolant flowing through the part of the cooling channel formed by the auxiliary bore holes.

The central bore hole may have a diameter corresponding to the diameter of the auxiliary bore hole. Alternatively, the diameter of the auxiliary bore holes may also be either larger or smaller than the central bore hole, depending on how much direct contact between coolant and body of the cooling plate is desired.

According to one embodiment of the disclosure, the emergency cooling tube may comprise lateral wings protruding into the auxiliary bore holes. Such lateral wings may increase the anchoring of the emergency cooling tube within the central bore hole, by limiting rotation of the emergency cooling tube.

The emergency cooling tube may comprise a central section between its end sections, wherein the central section has reduced wall thickness with respect to the end sections. Such reduced wall thickness improves the heat transfer between the coolant in the emergency cooling tube and the area within the cooling channel, without however weakening the strength in the end sections that is required to connect the emergency feed pipe.

According to a further embodiment, at least two emergency cooling tubes are arranged within the cooling channel. Preferably, the at least two emergency cooling tubes are arranged and configured so as to have merging end sections with common connection means for connecting said emergency feed pipe thereto. Such arrangement allows arranging e.g. two emergency cooling tubes in a single cooling channel, while nevertheless providing a single connection point for feeding coolant to the cooling tubes and thus providing easy access for connecting the emergency feed pipe.

Preferably, the cooling plate comprises an emergency feed pipe for connection to the emergency cooling tube, the emergency feed pipe being arranged through the coolant feed pipe, either coaxially or with parallel axes.

The connection means may be screw fit, bayonet fit, or any other appropriate means for connecting the emergency feed pipe to the emergency cooling tube.

The present disclosure also concerns the use of a cooling plate for metallurgical furnace as described above, wherein the use comprises the following steps:

- detecting a leak of the coolant from the cooling channel;
- interrupting the feed of coolant through the cooling channel;
- feeding an emergency feed pipe through the coolant feed pipe;
- connecting the emergency feed pipe to the emergency cooling tube; and
- feeding coolant via the emergency feed pipe to the emergency cooling tube and through the cooling plate.

BRIEF DESCRIPTION OF THE DRAWINGS

Further details and advantages of the present disclosure will be apparent from the following detailed description of several not limiting embodiments with reference to the attached drawings, wherein.

DETAILED DESCRIPTION

Figure 1:
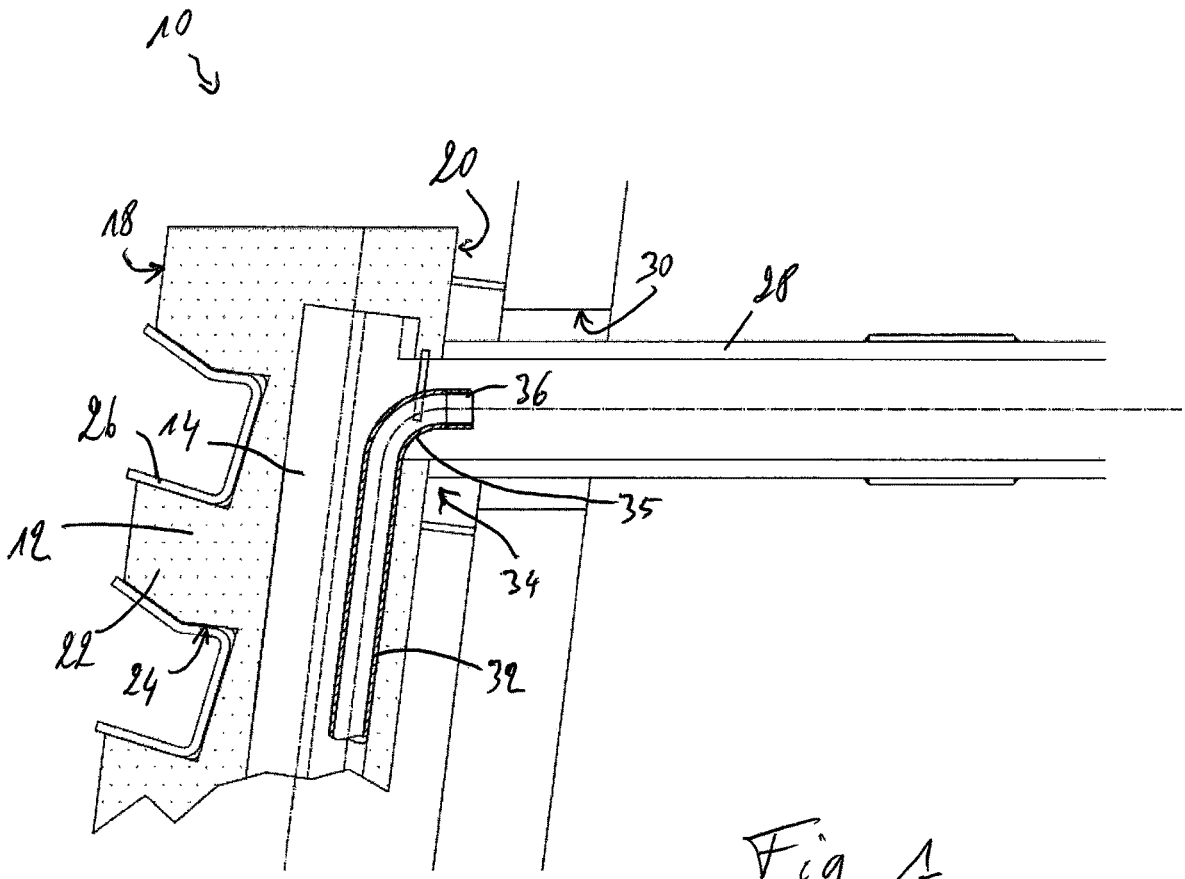
FIG. 1 is a cross-section through a cooling plate according to a first embodiment of the present disclosure, used in normal operating mode.

FIG. 1 schematically shows an upper portion of a cooling plate 10 comprising a body 12 that is typically formed from a slab e.g. made of a cast or forged body of copper, copper alloy or steel. Furthermore, the body 12 has at least one conventional cooling channel 14 embedded therein. Typical cooling plates 10 comprise at least four cooling channels 14 in order to provide a heat evacuating protection screen between the interior of the furnace and the outer furnace shell 16 (also referred to as armor). FIG. 1 shows the cooling plate 10 mounted onto the furnace shell 16. The body 12 has a front face generally indicated 18, also referred to as hot face, which is turned towards the furnace interior, and an opposite rear face 20, also referred to as cold face, which in use faces the inner surface of the furnace shell 16.

As is known in the art, the front face 18 of body 12 advantageously has a structured surface, in particular with alternating ribs 22 and grooves 24. When the cooling plate 10 is mounted in the furnace, the grooves 24 and lamellar ribs 22 are generally arranged horizontally to provide an anchoring means for a refractory brick lining (not shown).

During operation of a blast furnace or similar, the refractory brick lining erodes due to the descending burden material, causing the cooling plates to be unprotected and exposed to the harsh environment inside the blast furnace.

The front face 18 of body 12 may be provided with means for protecting the cooling plate against abrasion. One example of such means may be, as represented in FIG. 1, metal inserts 26 arranged in the grooves 24.

However, as the cooling plate 10 is exposed to the harsh environment inside the blast furnace, abrasion of the cooling plate occurs. If openings are created between the cooling channel 14 and the front face 18 of the body 12, either through cracks or abrasion, coolant from the cooling channel 14 can leak into the furnace.

At the rear face 20 of the body 12, the cooling plate 10 is provided with a coolant feed pipe 28 which is generally welded to the cooling plate 10 to feed coolant to the cooling channel 14. The coolant feed pipe 28 passes through an opening 30 in the furnace shell 16 and is connected to a coolant feed system (not shown)

The cooling channel 14 within the body 12 of the cooling plate 10 can be obtained by any known means, such as e.g. casting or drilling.

According to the present disclosure, an emergency cooling tube 32 is preinstalled within the cooling channel 14. Such an emergency cooling tube 32 has a cross-section that is smaller than that of the cooling channel 14 and comprises at its end sections 34—only one of which is visible on FIG. 1—a bent portion 35 with, at its extremity, connection means 36 for connecting an emergency feed pipe thereto when required.

Figure 2:
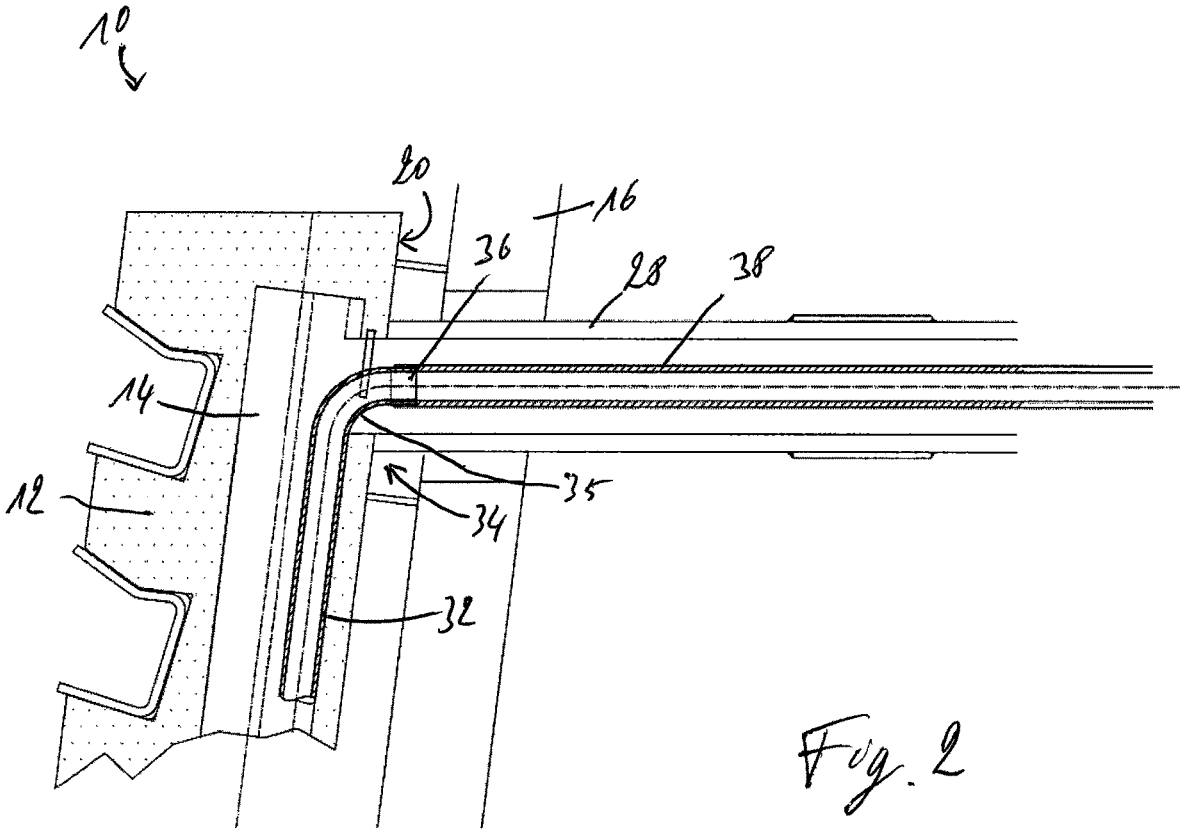
FIG. 2 is a cross-section of the cooling plate of FIG. 1, used in an emergency operating mode.

FIG. 2 shows the cooling channel 14 of FIG. 1 with such an emergency feed pipe 38 connected to the emergency cooling tube 32. The emergency feed pipe 38 is arranged within the coolant feed pipe 28 and connects to the emergency cooling tube 32 at the connection means 36. Such connection means 36 may be screw fit, bayonet fit, snap fit, or any similar appropriate means.

During normal use, the cooling plate is used as shown in FIG. 1, i.e. without the emergency cooling tube 32. Coolant is fed via the coolant feed pipe 28 to the cooling channel 14 and flows through the cooling channel 14 from one end to the other. Preferably, the coolant is in direct contact with the material of the body 12 of the cooling plate 10, so as to warrant a good heat transfer between the body 12 and the coolant. If the ends 34 of the emergency cooling tube 32 are left open, coolant also flows through the emergency cooling tube 32. As can be seen in FIG. 1, the emergency cooling tube 32 is preferably arranged within the cooling channel 14 furthest away from the front face 18 of the cooling plate. In other words, the emergency cooling tube 32 is arranged against the wall of the cooling channel 14 facing the rear face 20 of the cooling plate 10. It follows that the coolant flowing through the cooling channel 14 is in direct contact with the largest possible area of the body 12 facing the front face 18 of the cooling plate 10, thus ensuring the best possible heat transfer between the body 12 and the coolant.

Figure 3:
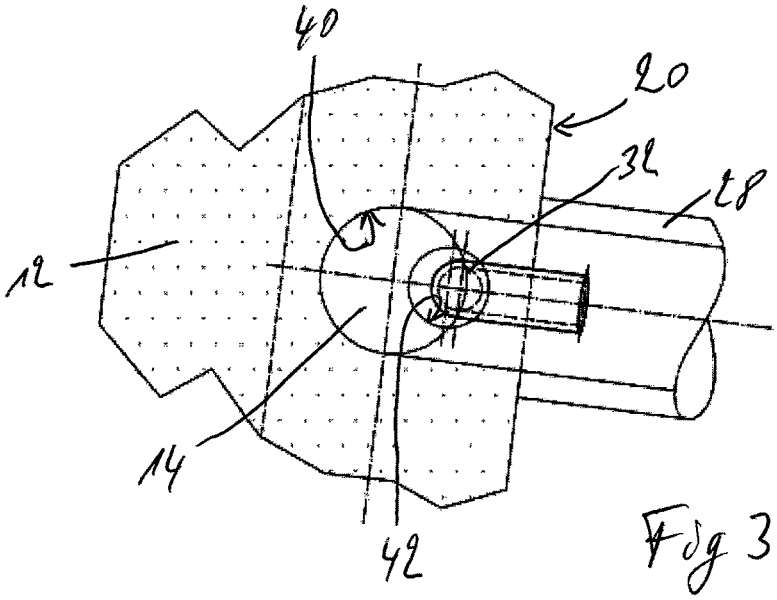
FIG. 3 is a cross-section through a cooling channel of the cooling plate of FIG. 1.

FIG. 3 is a cut through a section of a cooling plate showing the cross-sections of the cooling channel 14 and the emergency cooling tube 32. While the cooling channel 14 may be formed by a single cylindrical bore hole, the cooling channel 14 of the embodiment shown in FIGS. 1 to 3 is formed by a first bore hole 40 and a smaller, second bore hole 42, wherein the first and second bore holes 40, 42 overlap. The second bore hole 42 is arranged in direction of the rear face 20 and is dimensioned so as to accommodate the emergency cooling tube 32 such that a large part of the emergency cooling tube 32 is no longer located within the first bore hole 40. Thereby, the effective cross-section of the first bore hole 40, forming the essential part of the cooling channel 14, is less reduced by the presence of the emergency cooling tube 32.

Purely as illustrative example, the first bore hole 40 may have a diameter between 50 and 60 mm, while the second bore hole 42 may have a diameter between 25 and 35 mm. The emergency cooling tube 32 may have a diameter of about 20 mm.

In operation, coolant is fed to the cooling channel 14 via the coolant feed pipe 28. The coolant then traverses the body 12 of the cooling panel 10 via the cooling channel 14 from one end to the other before leaving the cooling plate via a coolant feed pipe 28 at the other end. The coolant may also be fed through the emergency cooling tube 32.

If a leak is detected, i.e. if the body 12 of the cooling plate is damaged in such a way that coolant leaks towards the front face 18 of the cooling panel 10 and thus into the furnace, the feeding of coolant through the coolant feed pipe 28 is interrupted. An emergency feed pipe 38 is then fed through the coolant feed pipe 28 and connected to the emergency cooling tube 32 already present in the cooling channel 14. Coolant is then fed via the emergency feed pipe 38 to the emergency cooling tube 32.

Due to the fact that the emergency cooling tube 32 is pre-installed within the cooling channel 14, there is no need to painstakingly try to feed a flexible hose through the damaged cooling channel 14. Indeed, all that is required is to fit the emergency feed pipe 38 to the emergency cooling tube 32 and cooling of the cooling panel 10 can be resumed very quickly. The downtime of the damaged cooling panel 10 is very much reduced.

While the damaged cooling panel 10 is being operated with coolant being fed through the emergency cooling tube 32, the cooling panel 10 is sufficiently cooled to continue to function correctly. Indeed, the continued cooling of the cooling panel 10 prevents further damage to the cooling panel 10. More importantly, the continued cooling of the cooling panel 10 prevents destruction thereof and thus also prevents the furnace shell to be exposed to the harsh environment of the furnace. The damaged cooling panel 10 can be operated until the next major scheduled downtime of the blast furnace, during which the damaged cooling stave may then be replaced.

Figure 4:
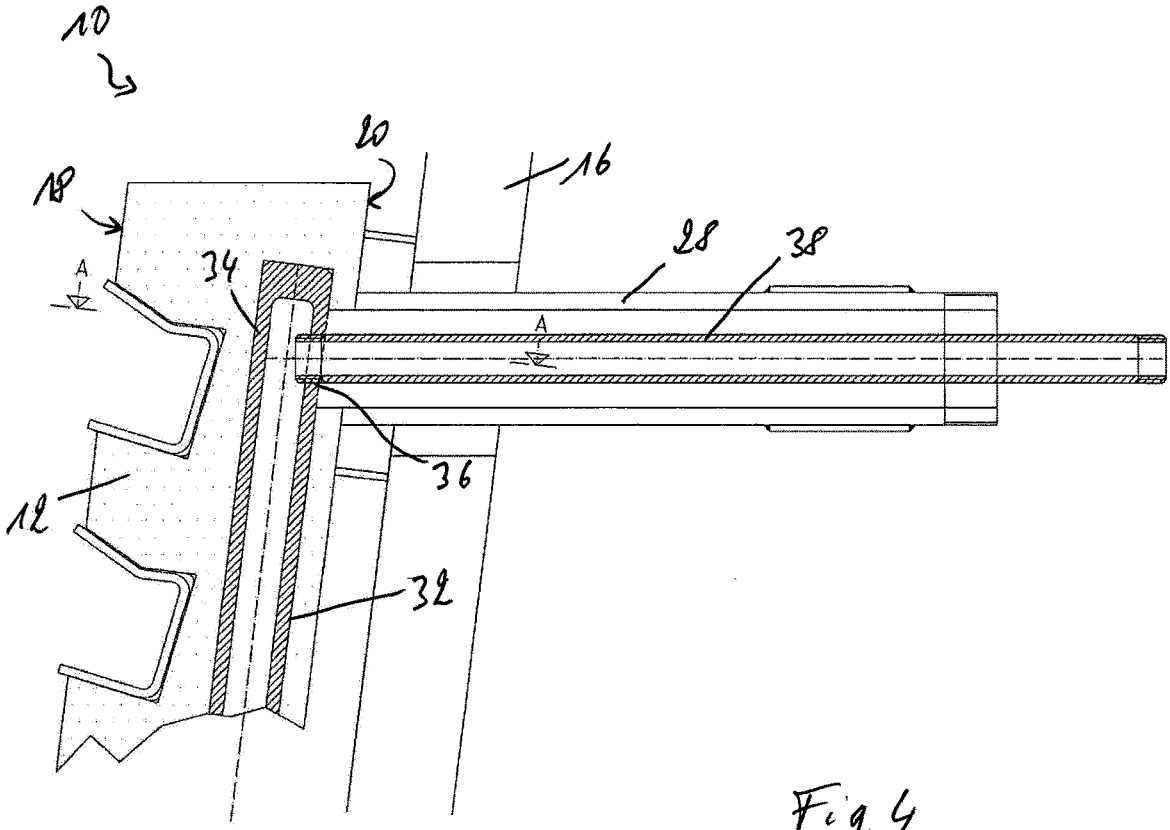
FIG. 4 is a cross-section through a cooling plate according to a second embodiment of the present disclosure, used in an emergency operating mode.

According to a second embodiment of the disclosure, as seen in FIG. 4, the emergency cooling tube 32 is a straight piece of piping with closed ends. The end section 34 of the emergency cooling tube 32 comprises connection means 36 in a lateral wall portion for connecting an emergency feed pipe 38 thereto when required. As above, the connection means 36 may be screw fit, bayonet fit, snap fit, or any similar appropriate means.

Figure 5:
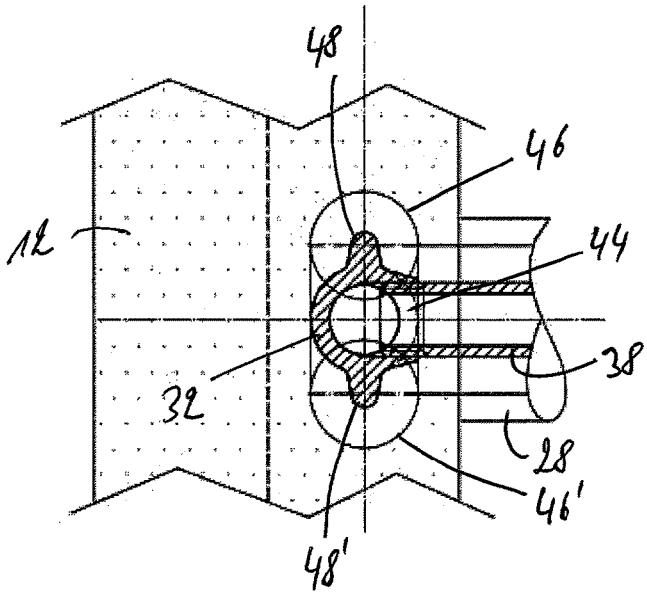
FIG. 5 is a cross-section through a cooling channel of the cooling plate of FIG. 4

As can be more clearly seen in FIG. 5, the cooling channel 14 is in this embodiment formed by three bore holes: a central bore hole 44 and two auxiliary bore holes 46, 46' either side of the central bore hole 44, wherein the auxiliary bore holes 46, 46' both overlap with the central bore hole 44. The central bore hole 44 is dimensioned so as to accommodate the emergency cooling tube 32 therein. The outer diameter of the emergency cooling tube 32 essentially corresponds to the diameter of the central bore hole 44, such that emergency cooling tube 32 snuggly fits into the central bore hole 44. In order to further avoid any rotation of the emergency cooling tube 32 within the central bore hole 44, the emergency cooling tube 32 is further provided with lateral wings 48, 48' which protrude into the auxiliary bore holes 46, 46'. Although the central bore hole 44 is filled with the emergency cooling tube 32, coolant is still allowed to be in direct contact with the body 12 through the auxiliary bore holes 46, 46'.

Purely as illustrative example, the central bore hole 44 may have a diameter between 35 and 45 mm, while both auxiliary bore holes 46, 46' may have the same diameter. The emergency cooling tube 32 may also have the same outer diameter.

Figure 6:
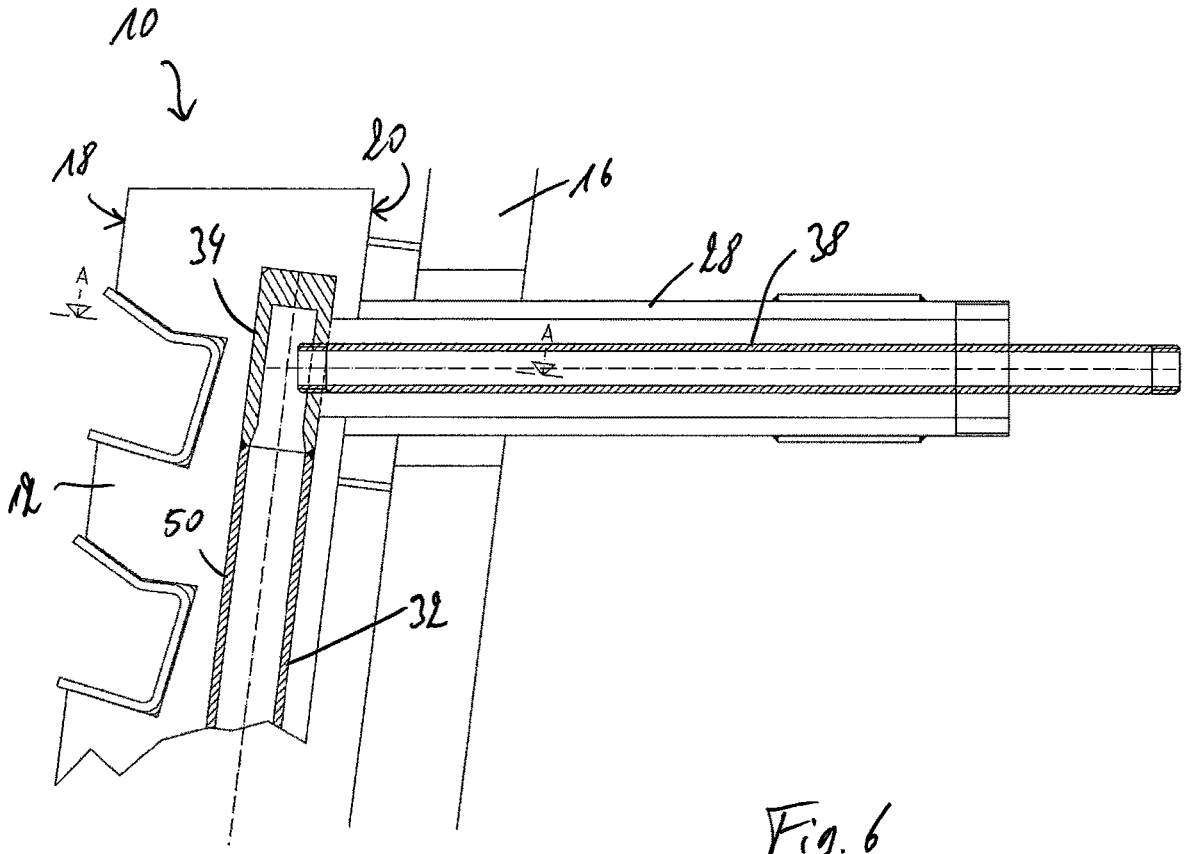
FIG. 6 is a cross-section through a cooling plate according to a third embodiment of the present disclosure, used in an emergency operating mode.

FIG. 6 shows a third embodiment of the disclosure, which is similar to that of FIG. 4. However, the emergency cooling tube 32 has a central section 50 of reduced wall thickness with respect to the end section 34. Such a reduces wall thickness allows for a better heat transfer between the body 12 and the coolant circulating in the emergency cooling tube 32.

Figure 7:
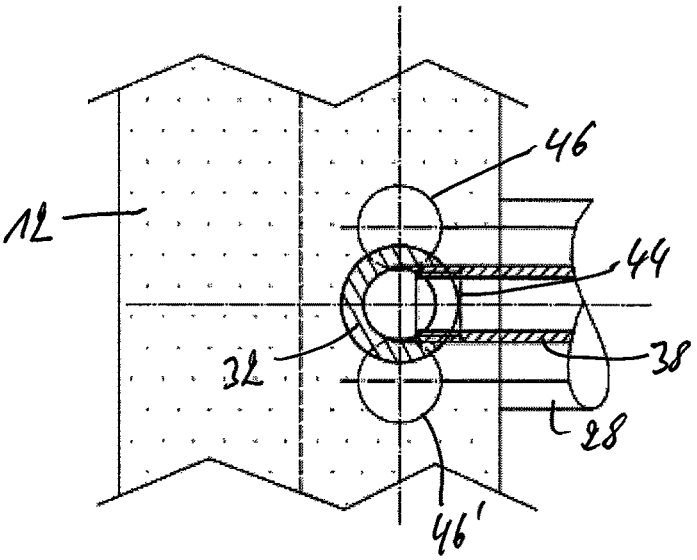
FIG. 7 is a cross-section through a cooling channel of the cooling plate of FIG. 6.

FIG. 7 shows an alternative bore hole arrangement as that of FIG. 5. Indeed, according to this embodiment the auxiliary bore holes 46, 46' have a smaller diameter than the central bore hole 44.

Again, purely as illustrative example, the central bore hole 44 may have a diameter of about 40 mm, while both auxiliary bore holes 46, 46' may have a diameter of about 30 mm. The emergency cooling tube 32 may have an outer diameter of about 40 mm such as the central bore hole 44.

While in the above detailed description and in the figures, only bore holes and emergency cooling tubes of circular cross-section have been described and shown, it is clear that other shapes are also possible and within the scope of the present disclosure. The bore holes and/or emergency cooling tubes may e.g. be flattened or even rectangular in shape.

Figure 8:
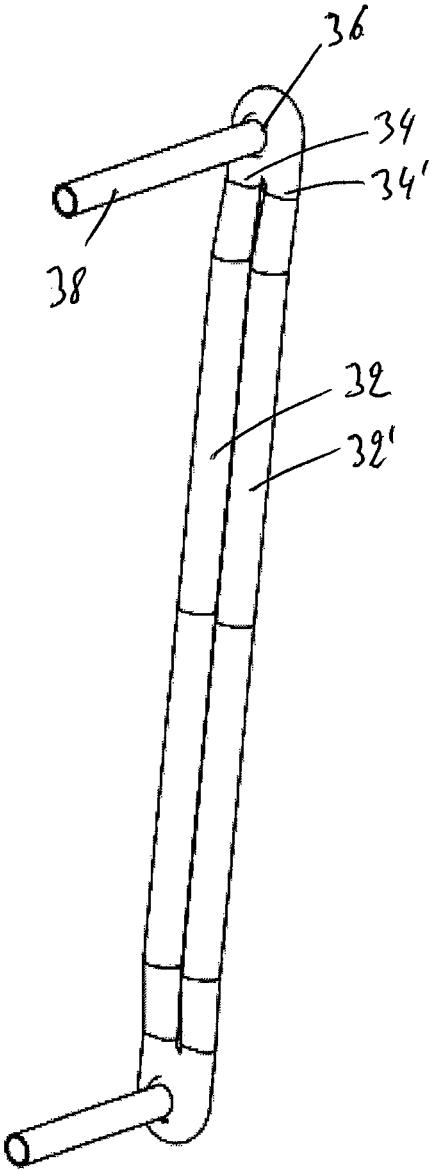
FIG. 8 is a perspective view of an emergency cooling tube arrangement according to a fourth embodiment of the present disclosure.

Also, the number of emergency cooling tubes arranged in one cooling channel 14 is not limited to one. FIG. 8 shows an arrangement of two emergency cooling tubes 32, 32' having merging end sections 34, 34' such that a single emergency feed pipe 38 can be connected thereto. The two emergency cooling tubes 32, 32' are arranged so as to provide a gap therebetween. When installed in a cooling channel of oblong cross-section, coolant fed to the cooling channel 14 can flow along the cooling channel between the two emergency cooling tubes 32, 32'. While not visible in the preceding figures, FIG. 8 shows that the emergency cooling tubes have upper and lower end sections, with respective connection means for respective emergency feed pipes, one for feeding coolant to the emergency cooling tubes and one for evacuating coolant therefrom.

The invention claimed is:

1. A cooling plate for a metallurgical furnace comprising: a body with a front face and an opposite rear face, the front face being turned towards a furnace interior when the cooling plate is in use; a cooling channel formed in the body and having an opening in said rear face; a coolant feed pipe being connected to said rear face and being in fluid communication with said cooling channel; an emergency cooling tube arranged within said cooling channel, said emergency cooling tube having a cross-section smaller than a cross-section of said cooling channel; connection means disposed on an end section of the emergency cooling tube for connecting an emergency feed pipe thereto, said connection means being arranged within said cooling channel or said coolant feed pipe; wherein, in a normal operation, coolant is fed to the cooling channel via the coolant feed pipe whereas the connection means of the emergency cooling tube is physically disconnected from the emergency feed pipe; and wherein, in an emergency operation, the feeding of coolant through the coolant feed pipe is interrupted and the emergency cooling tube is physically connected to the emergency feed pipe via the connection means, whereby coolant is then fed via the emergency feed pipe to the emergency cooling tube.

2. The cooling plate according to claim 1, wherein said cross-section of said emergency cooling tube is at most three quarters, of the cross-section of said cooling channel.

3. The cooling plate according to claim 1, wherein said end section of said emergency cooling tube comprises a bent portion.

4. The cooling plate according to claim 3, wherein said cooling channel is formed by a first bore hole and a second bore hole, said first and second bore holes overlapping, said second bore hole having a smaller diameter than said first bore hole and being arranged in a direction facing said rear face of said cooling plate, said second bore hole being arranged and dimensioned so as to accommodate said emergency cooling tube.

5. The cooling plate according to claim 1, wherein said end section is straight and comprises said connection means in a lateral portion of said end section.

6. The cooling plate according to claim 5, wherein said cooling channel is formed by a central bore hole and two auxiliary bore holes arranged either side of said central bore hole, both said auxiliary bore holes overlapping said central bore hole, said central bore hole being arranged and dimensioned so as to accommodate said emergency cooling tube.

7. The cooling plate according to claim 6, wherein said central bore hole has a diameter essentially corresponding to an outer diameter of said emergency cooling tube.

8. The cooling plate according to claim 6, wherein said central bore hole and said auxiliary bore holes have the same diameter.

9. The cooling plate according to claim 6, wherein said central bore hole has larger diameter than said auxiliary bore holes.

10. The cooling plate according to claim 6, wherein said emergency cooling tube comprises lateral wings, said lateral wings protruding into said auxiliary bore holes.

11. The cooling plate according to claim 6, wherein said emergency cooling tube comprises a central section, wherein said central section has reduced wall thickness with respect to said end section.

12. The cooling plate according to claim 1, wherein at least two emergency cooling tubes are arranged within said cooling channel.

13. The cooling plate according to claim 12, wherein said at least two emergency cooling tubes are arranged and configured so as to have merging end sections with common connection means for connecting said emergency feed pipe thereto.

14. The cooling plate according to claim 1, wherein said cooling plate comprises an emergency feed pipe for connection to said emergency cooling tube, said emergency feed pipe being arranged through said coolant feed pipe.

15. The cooling plate according to claim 1, wherein said connection means comprises screw fit, bayonet fit, or any other appropriate means for connecting said emergency feed pipe to said emergency cooling tube.

16. The cooling plate according to claim 1, wherein said emergency cooling tube comprises a coating of resistant material.

17. Method for operating a cooling plate for a metallurgical furnace, the method comprising the steps of:

providing a cooling plate according to claim 1;

detecting a leak of the coolant from the cooling channel;

interrupting the feed of coolant through the cooling channel;

feeding an emergency feed pipe through the coolant feed pipe;

connecting the emergency feed pipe to the emergency cooling tube; and feeding coolant via the emergency feed pipe to the emergency cooling tube and through the cooling plate.

18. Method according to claim 17, wherein in a normal operation, the connection means of the emergency cooling tube is physically disconnected from the emergency feed pipe; and in an emergency operation, the emergency cooling tube is physically connected to an emergency feed pipe via the connection means.

* * * * *